United States Patent [19]

Piccini

[11] 4,378,113

[45] Mar. 29, 1983

[54] METHOD FOR WARMING-UP WRISTS

[76] Inventor: Silvio D. Piccini, 13620 SW. 74 Ct., Miami, Fla. 33158

[21] Appl. No.: 227,917

[22] Filed: Jan. 23, 1981

Related U.S. Application Data

[63] Continuation of Ser. No. 27,574, Apr. 2, 1979, abandoned.

[51] Int. Cl.[3] ..... A63B 21/00

[52] U.S. Cl. ..... 272/128; 272/124

[58] Field of Search ..... 272/67, 68, 124, 143, 272/DIG. 4, 128, 117

[56] References Cited

U.S. PATENT DOCUMENTS 325,987 9/1885 Sparks ..... 272/124

3,843,117 10/1974 Johnson ..... 272/128

FOREIGN PATENT DOCUMENTS 18621 of 1896 United Kingdom ..... 272/124

855312 11/1960 United Kingdom ..... 272/128

*Primary Examiner*—Richard C. Pinkham

*Assistant Examiner*—William R. Browne

*Attorney, Agent, or Firm*—Jack E. Dominik

[57] ABSTRACT

A method for warming-up an athlete's wrist. The method includes the step of disposing the hands in partially overlapping relation and with the fingers curved generally similar to the grasping of the handle of a sporting implement and in a position in front of the athlete's midsection. Then the overlapping hands are repeatedly alternated toward and away from the midsection, or leftward and rightward in front of the midsection, or the wrists are twisted so that the hands trace out a cone. In the aforedescribed alternating movements of the overlapping hands, an alternating impact is applied to the hands; and a radially outward force is applied to the hands while the wrists are being twisted.

6 Claims, 2 Drawing Figures

METHOD FOR WARMING-UP WRISTS

This is a continuation of application Ser. No. 27,574, filed Apr. 2, 1979, now abandoned.

BACKGROUND OF THE INVENTION

1. Field of the Invention

This invention relates to warm-up exercises for athletes, and more particularly to wrist warm-up exercises for baseball players.

2. Description of the Prior Art

U.S. Pat. No. 3,136,546 to Connolly shows a swingable practice game implement with a slideable weight. The weight member is disposed within a hollow chamber and held in sliding engagement therein. Thus, when the athlete swings the implement, the weight will respond to the centrifugal force thereby generated by sliding within the hollow chamber.

Connolly's purpose in providing an axially projectable and retractable weight within the implement is to teach the athlete to perfect his timing in swinging the implement. When the centrifugal forces effect the dislodging of the weight from its initial inert position, the movement of the weight makes an audible clicking sound, thereby signaling the athlete that the weight has been dislodged from its initial position.

Another device employing a movable point mass within the interior of the athletic implement is shown in U.S. Pat. No. 2,772,887 to Blake.

U.S. Pat. No. 514,420 to Jacobus shows a baseball bat having a hollow chamber with a ball weight or piston member free to slide within the hollow chamber.

U.S. Pat. No. 875,273, shows a baseball bat provided with an interior bore containing heavy material therein to make the bat heavier than normal and to thereby aid a batter in his warm-up.

U.S. Pat. No. 1,524,196 to Matthews shows a truncated implement for exercising one's golf swing. The center of gravity of the implement is proportionately related to the center of gravity of full size club.

U.S. Pat. No. 3,955,816 to Bratt shows a warm-up bat filled with a flowable material such as sand. This construction is designed to simulate the feel of an actual bat, while providing extra weight to aid the warm-up of the batter.

If an athlete desires to warm-up using any of the earlier devices, he must first move to a location distant from other athletes. Then, he must limit his warm-up exercise to the same motions he will employ when actually swinging his club or bat in a game situation.

Accordingly, it can be seen that there is a need to provide athletes with a method of warming-up that will not necessarily require them to employ only those motions needed when actually swinging a club or bat. A runner does not warm-up by simply running. He exercises muscles during his warm-up period in a manner different from which his muscles will be used when actually running. Accordingly, there is a need for an exercising method that an athlete desiring to warm-up may follow that does not restrict his motions merely to those motions required to actually swing a club or bat. The device usable in practicing the method should allow the athlete to flex his wrists in rotary motions, back and forth motions, or lateral motions if he no desires.

SUMMARY OF THE INVENTION

Method

The method of the invention is followed by an athlete grasping and manipulating a club-like implement having a truncated handle and body. A hollow chamber within the implement is partially filled with a fluid such as water. When the athlete manipulates the device by swinging the body portion to and fro, side to side, or in a rotary fashion, the fluid will shift within the hollow chamber, thereby exerting a gentle pull on the forearm muscles of the athlete. The motion further serves to warm the athlete's wrists up in a thorough manner not possible with earlier devices.

Apparatus

The club-like implement useful for practicing the method of the invention is approximately equal in length to an athlete's forearm. The implement has an abbreviated handle portion to prevent the athlete from grasping the implement in the same manner that he or she would grasp a baseball bat or a golf club. The abbreviated body portion of the implement has a circular cross-section increasing in area from the proximal end of the body portion to the distal end thereof. An annular ridge is formed between the abbreviated handle and the abbreviated body, to further remind the athlete to graps the implement in accordance with the method disclosed herein. The implement is hollow, and has an aperture formed in the end portion of the handle thereby providing a filling means. In the preferred embodiment, the end portion of the handle is convave, thereby further providing a funnel to aid charging operation.

It is therefore an object of the present invention to provide a method for warming-up an athlete's wrist that does not restrict him to the motions to be undertaken in actual game situations.

Still another object of the invention is to provide a novel method of charging a hollow practive device with a flowable material to thereby allow the weight of the exercise device to be varied easily.

BRIEF DESCRIPTION OF THE DRAWINGS

Further objects and advantages of the present invention will become apparent as the following description proceeds, taken in conjunction with the accompanying drawings in which.

DESCRIPTION OF THE PREFERRED EMBODIMENT

Figure 1:
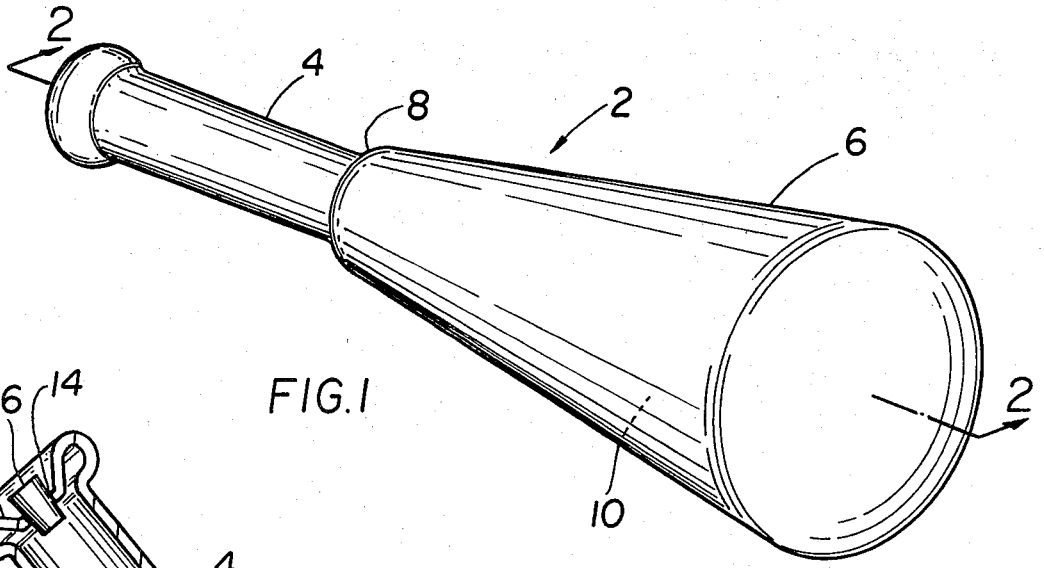
FIG. 1 shows a perspective view of the device used in practicing the method of the invention.
Figure 2:
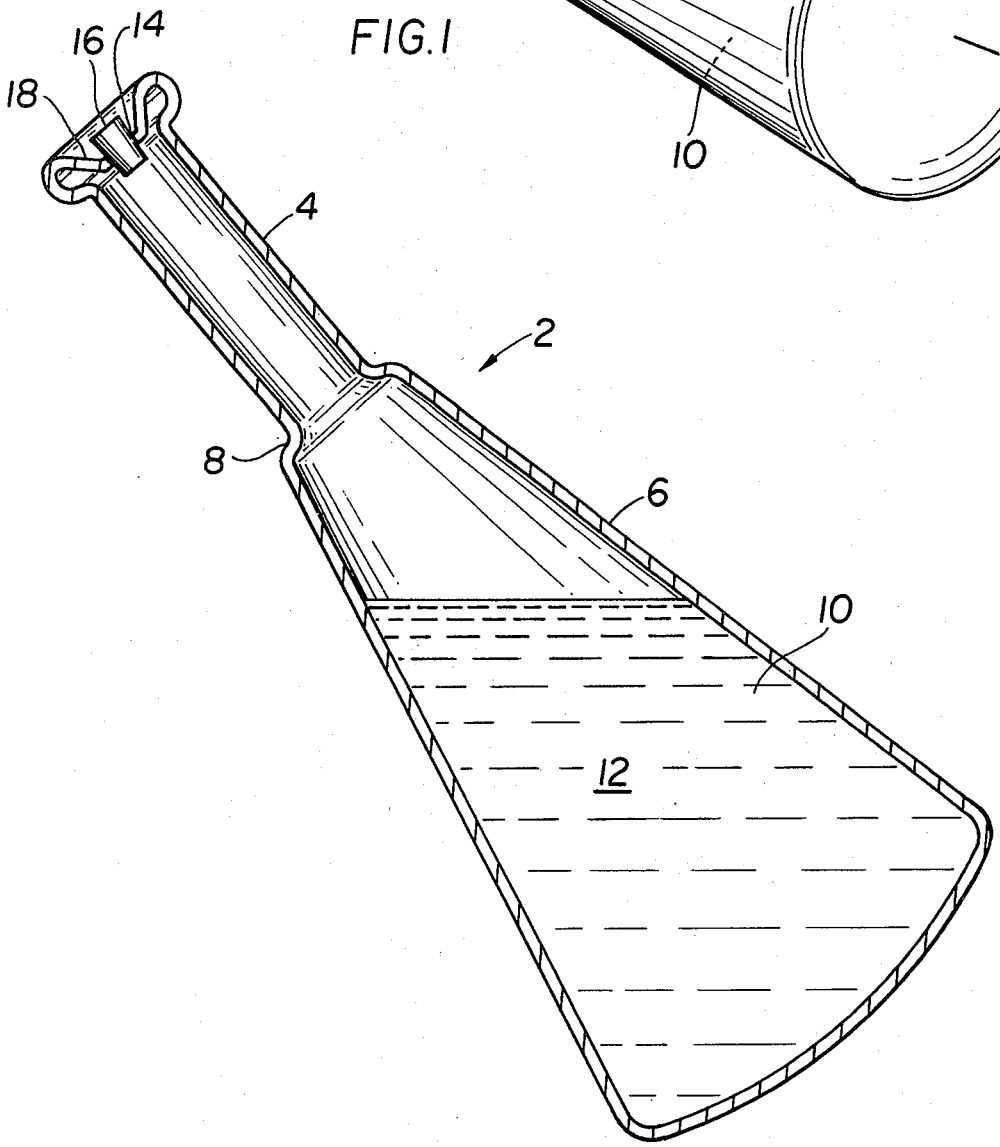
FIG. 2 shows a cross-sectional view of the device, taken along lines 2—2 of FIG. 1.

A hollow club useful for practicing the method of the invention is shown in FIG. 1, and generally designated 2. The club comprises an abbreviated handle portion 4 and an abbreviated body portion 6. The body portion 6 of the device has a circular cross-section, the cross-sectional area being greater at the outermost end of the body portion than at the point of juncture of the body portion with the handle portion. The overall length of the club, in the preferred embodiment, is approximately fourteen inches. This length is determined by approximating the measured length of an athlete's forearm. Thus, when the inventive method is practiced, the club 2 will not interfere with other athletes in the vicinity of the exercising athlete, nor will the club strike the athlete's body during the course of the warning-up exercise.

The handle 4 is proportioned so that its length is only slightly greater than the width of an athlete's hand measured across the palm and perpendicular to the fingers. Thus, when the athlete desires to practice the method, one of his or her hands must overlie the other hand. Earlier devices attempt to simulate, in warm-up devices, the actual feel of a club or bat to be used by the athlete in game situations. By providing the abbreviated handle portion 4, the inventor has provided a device which deliberately makes no effort to simulate the feel of an actual athletic implement. For example, a baseball player, unlike a golfer, normally would not challenge a pitcher on the mound while gripping a bat with one of his hands overlapping the other. Instead, the batter will normally grip the bat with his dominant hand in encircling engagement with the bat handle, spaced upwardly from the recessive hand. Even if the batter prefers the cross-handed style with his dominant hand below his recessive hand, he will still normally avoid any substantial overlapping of his hands.

The purpose, therefore, of the truncated handle portion 4 is to allow both of the athlete's hands to grip the handle portion of the device, with one hand overlying the other. The dominant may overlie the recessive, or vice-versa. This overlying relationship of the hands to each other allows the method hereindisclosed to be practiced comfortably. Further, providing an abbreviated handle portion 4, suggests to the athlete that he is not to grip the device by employing the same grip that he would on a bat or club in an actual game-situation. The purpose of the device, unlike earlier devices, is to allow the athlete to warm-up his wrists without restricting himself to the movements employed in actual game-situations. The provision of a handle portion of a dimension sufficient to accomodate both of the athlete's hands in non-overlying relationship will result in the athlete gripping the implement with his game-situation grip, which results in the athlete restricting his warm-up motions to those motions actually employed in game situations.

To further impress upon the athlete that the method to be employed when using the device disclosed herein requires his hands to be in overlapping relationship during the excercise, an annular ridge 8 is disclosed at the point of juncture between the abbreviated handle portion and the abbreviated body portion. This annular ridge serves to guide the athlete's hands to the lower, or proximal portion of the device. Thus, if he reverts to his game situation grip while warming-up, the feel of the annular ridge will tactilely remind him that the device is to be employed with both hands on the abbreviated handle portion of the device.

The annular ring further serves to guide the device in a rotary motion when the method of the invention, is practiced.

The hollow chamber 10 of the device is partially filled with a non-gaseous flowable material 12, preferably water. The fluid 12 is introduced into the hollow chamber 10 through an aperture 14 formed in the center of the end of the handle portion 4, which aperture is capped by plug 16. The end portion 18 of the handle is concave, thereby serving as a funnel when the flowable material is poured into the hollow chamber.

When the athlete desires to warm-up his wrists, he disengages plug 16 from sealing engagement with the aperture 14, and charges the hollow chamber 10 with, for example, water. If the athlete is comfortable with the device 80% filled with water, he reengages the plug 16 into fluid tight relationship with the aperture 14, after having filled the device 2 as desired. While preferably seated, he then graps the abbreviated handle portion 4 of the device 2 by placing both hands on the handle portion thereof below the annular ring. One of his hands must overlie the other, due to the truncated configuration of the handle 4. He then tosses the device 2 while maintaining his grip on the handle 4, away from his body. This causes the water 12 contained therein to flow to the distal end of the device 2. This shifting of weight will exert a pull on the forearm muscles of the athlete. He then tosses the device 2 back toward his body while continuing to maintain his grip on the handle 2. The athlete repeats the forward and rearward tossing of the device in this manner until he feels his wrists growing warmer due to the increased circulation of blood therein caused by the exercise.

Next, the athlete tosses the device 2 from one side to the other, in a lateral motion relative to the plane of his body. Completing his warm-up, the athlete rotates the device 2 such that a point on the distal end thereof will generate a circle lying in a horizontal plane forward of his body.

Due to the abbreviated overall dimension of the device 2, the athlete may warm-up in the vicinity of other athletes. He will not strike his own body as the device is tossed rearward or rotated. Even more importantly, the natural shifting of the flowable material within the device will exert a very natural pull on the athlete's forearm muscles. This contrasts with the earlier devices that employed the abrupt shifting of a point mass. Thus, the undesirable attributes of the earlier devices having shifting weights of non-flowable material therein is overcome. Most importantly, the frontward and rearward, left and right, and rotary movements possible with the device are not movements which are employed by the athlete in actual game situations. Thus, the method provides for a thorough warm-up of the wrists. The gradual pull of the forearm muscles provided by the shifting of the flowable materials further helps to reduce the tendency of an athlete's muscles in his forearm to become shortened. Athletes often squeeze rubber balls or hand grips to increase the strength of their grip. Such exercise inevitably causes the muscles of the forearm to shorten. Thus, the stretching of these shortened gripping muscles is achieved as a by-product of the warming-up exercise.

It will be noted by the astute observer of this method that a further by-product of the method is the provision of an outlet for the release of tension by athletes. For example, baseball players commonly sit on a bench when their team is at bat, nervously awaiting their turn at the plate. They cannot warm-up until they reach the on deck circle, and even this warm-up period may be severally limited if the player before them is retired quickly or gets on base quickly. The time spent in the dug out is generally wasted. The full size warm-up devices of old are dangerous to use in the close confines of a dug out. The shorter devices of old merely attempt to simulate the feel of an athletic implement, thereby depriving the batter of a thorough wrist warming-up. Consequently, the players simply do not excercise while awaiting their turn at bat. This lack of something to do results in the players fidgeting nervously. By warming-up their wrists with the device and method now disclosed, the player is accomplishing the two-fold purpose of not only getting ready for his turn at bat, but also of relieving or reducing his nervous tension while awaiting his exit from the dug-out.

The implement useful for practicing the inventive method has been filled to differing amounts by differing non-gaseous flowable materials so that the effects of such variation on the effectiveness of the method could be observed. The non-gaseous flowable materials tested were water, sand, and buckshot. The method was practiced with the implement 20% full, 40% full, 60% full, 80% full, and 100% full of each of the three fluidic substances. For clarity of presentation, the results of the tests are presented in columnar fashion below. The tests were rated either satisfactory (S) or unsatisfactory (U).

| | Water | Sand | Buckshot |
|---|---|---|---|
| 20% | U | U | U |
| 40% | U | U | S |
| 60% | U | U | S |
| 80% | S | S | U |
| 100% | U | U | U |

The tests were conducted by adults and children. It was found that adults achieved the best result when the device was to 60–70% filled with buckshot. However, due to the weight of the device when so filled, it is not recommended that children employ the inventive method when the device is filled 60–70% with buckshot.

However, the test indicated that both adults and children could practice the inventive method with equally good results when the device 2 is filled with between 75–80% water, and 70–75% with sand.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A method for warming-up an athlete's wrists, comprising the steps of:

disposing the hands in partially overlapping relation and with the fingers curved generally similar to the grasping of the handle of a sporting implement and in a position in front of the athlete's midsection, repeatedly alternating the position of said overlapping hands towards and away from said midsection, and applying an impact to the hands when disposed towards said midsection and to the hands when disposed away from said midsection to cause the forearm muscles to be pulled out and thereby warm-up the wrists.

2. The method of claim 1, further comprising the steps without regard to order of:

repeatedly alternating the position of said overlapping hands leftward and rightward while in front of said midsection, and applying an impact to the hands when disposed leftward in front of said midsection and to the hands when disposed rightward in front of said midsection to cause the forearm muscles to be pulled out and thereby warm-up the wrists.

3. The method of claim 2, wherein the athlete's hands in said partially overlapping relation grasp and oscillate a container partially filled with a flowable substance to alternately produce said impacts.

4. The method of claim 2, further comprising without regard to order the steps of:

repeatedly alternating the position of said overlapping hands, while in front of said midsection, by twisting the wrists so that the hands trace out a cone while applying a force directed approximately radially outward from the axis of said cone causing the forearm muscles to be pulled and thereby warm-up the wrists.

5. The method of claim 4 wherein the athlete's hands grasp and oscillate a container partially filled with a substance to alternately produce said impacts and said force.

6. The method of claim 1, wherein the athlete's hands in said partially overlapping relation grasp and oscillate a container partially filled with a flowable substance to alternately produce said impacts.

* * * * *